United States Patent [19]

Plo

[11] 4,204,359

[45] May 27, 1980

[54] FLYING TOY

[76] Inventor: Mateo O. Plo, Bailen St., no. 12, Madrid, Spain

[21] Appl. No.: 928,524

[22] Filed: Jul. 27, 1978

[30] Foreign Application Priority Data

Aug. 9, 1977 [ES] Spain ..... 461.493

[51] Int. Cl.[2] ..... A63H 27/00

[52] U.S. Cl. ..... 46/83; 46/82

[58] Field of Search ..... 46/83, 84, 85, 82

[56] References Cited

U.S. PATENT DOCUMENTS

| | | | |
|---|---|---|---|
| 1,573,527 | 2/1926 | Simonek | 46/83 |
| 2,938,300 | 5/1960 | Newbert et al. | 46/83 |

FOREIGN PATENT DOCUMENTS

| | | | |
|---|---|---|---|
| 745610 | 2/1956 | United Kingdom | 46/83 |

*Primary Examiner*—Louis G. Mancene
*Assistant Examiner*—Mickey Yu
*Attorney, Agent, or Firm*—Young & Thompson

[57] ABSTRACT

A flying toy of the rotating blade type, comprises a bladed spinner which is twirled by a shaft that is rotated by pulling a string that is wound about the shaft. Pivoted hooks are urged by the centrifugal force of an extended portion thereof, radially inwardly to retain the spinner for rotation with the shaft so long as the shaft is rotating. But when the string is fully unwound and the shaft stops rotating, then the inertia of those same weighted portions swings the hooks radially outwardly to release the spinner, which is thus launched. A flared bell on the toy receives the spinner when it falls again; and the string is wound back up on the shaft by an elastic that rotates the shaft in a direction opposite the unwinding direction.

4 Claims, 4 Drawing Figures

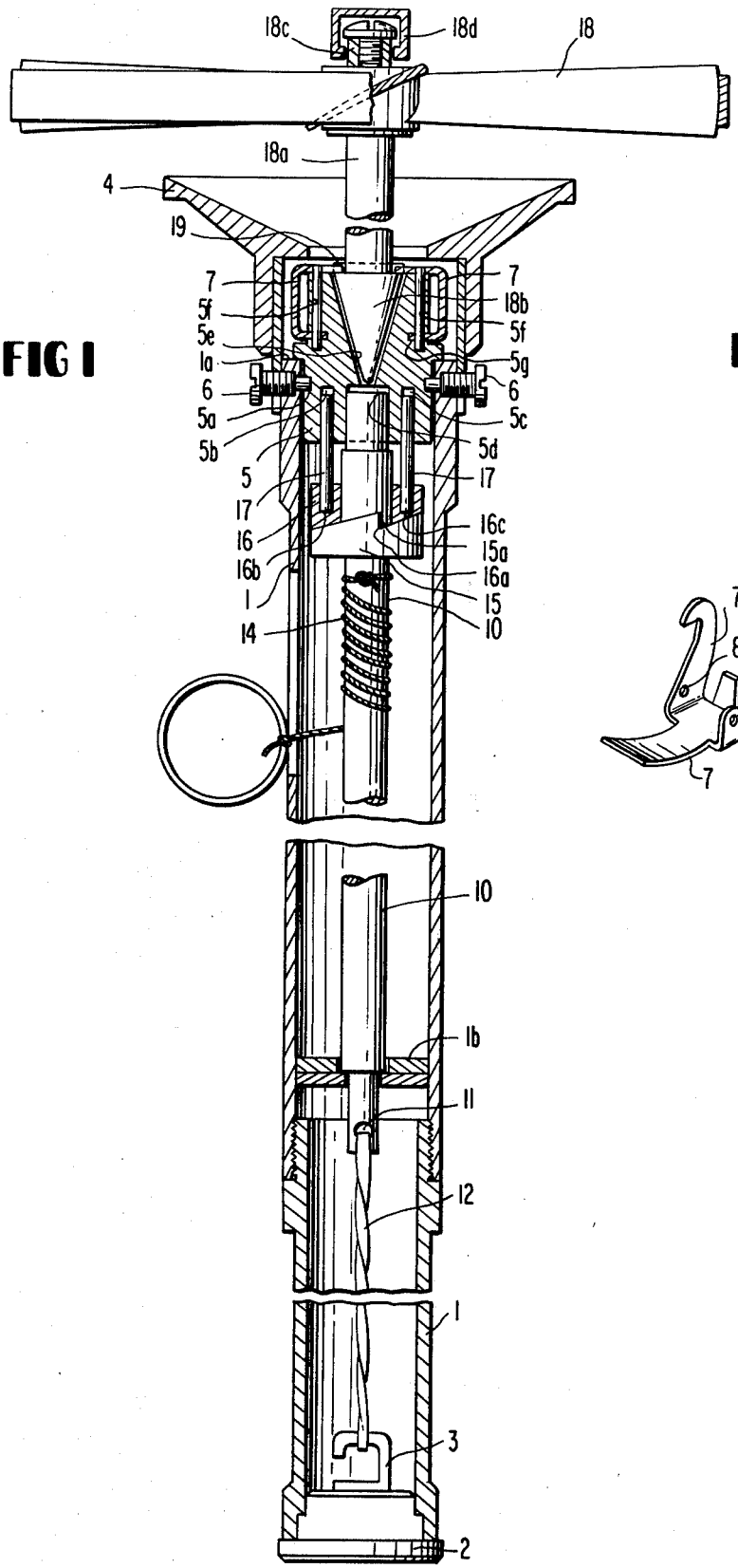
FIG 1
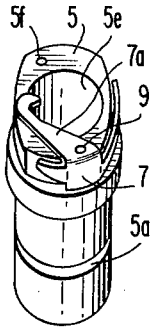
FIG 2
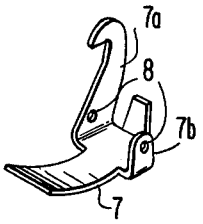
FIG 3
FIG 4
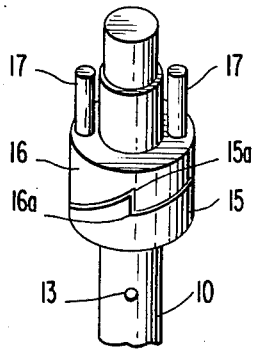

FLYING TOY

The present invention relates to a special type of toy comprising a simple device which, when activated, shoots off or launches gyroscope-like or rotating flying element susceptible to be caught with the launcher itself, so that it can be launched again, or picked up by hand, thus taking advantage of its rotation to use it like a top or similar toy.

It is then an extremely attractive toy on account of the variety of its possible effects, very easy to be handled without any danger to the user, and it has a great structural simplicity, all of which entitles it to protection through the grant of the patent of invention, which is hereby being applied for.

The different parts of the subject-matter of the invention will now be described, with reference to the attached drawings, in which one embodiment of the invention is shown by way of example only and with no intention of limiting the invention in any way.

In said drawings:

FIG. 1 shows two elevational and length-wise sectional views (the latter being the continuation of the lower portion of the former) of the toy according to the invention, with the gyroscope or flying element in place.

FIG. 2 shows a partial perspective view of the upper part of the coupling sleeve for the rotating flying element, provided with one of the two pieces which, depending on their position, serve as means for catching said flying element or for enabling it to be launched.

FIG. 3 is a perspective view of one of said pieces.

FIG. 4 shows a perspective view of the upper part of the rotating mechanism which makes the coupling sleeve for the rotating flying element to turn and which subsequently causes the latter to be shot off or launched.

In said figures:

No. 1 is the tubular element forming the housing or casing for the device that launches the rotating flying element. This tubular element, which can be formed by a single piece or by several cylindrical pieces suitably connected to one another, is cylindrical on the inside and has a uniforme diameter all along its length except for a portion at the top, where its diameter increases abruptly, thereby forming an interior peripheral seat (1*a*).

In addition, said tubular element includes on its inside, at a certain distance below the peripheral seat (1*a*), a small, transverse internal partition (1*b*) with a central hole.

No. 2 is a cap-like piece that is attached to the lower end of tubular element 1 in such a way that it can easily be removed from said tubular element but can not rotate with respect to it; on this purpose, both the cap-like piece and the tubular element are provided with the necessary means for ensuring reciprocal interlocking.

No. 3 is a hook integrally attached to the upper face of piece 2, in such a way that when said piece is connected to the lower end of tubular element 1, it is housed within said element.

No. 4 is a flared piece which snaps on the upper portion of tubular element 1.

No. 5 is a sleeve rotatably housed within the upper portion of tubular element 1. The lower half of this sleeve is cylindrical on the outside and slightly smaller in diameter than the upper half, the shape of which is nearer to that of a rectangular body with curved, convex sides; this difference in diameter forms a peripheral flange that makes it possible for the sleeve to rest on the interior peripheral seat 1*a* of tubular element 1.

This sleeve has, in its lower, cylindrical half, an exterior peripheral groove (5*a*), two axial holes (5*b* and 5*c*, respectively) that are diametrically opposite each other and open at the base of the sleeve, and an axial, cylindrical recess (5*d*) which also opens at the base of the sleeve and is located in the centre thereof.

In its upper, rectangular half, this sleeve has a central axial opening or recess (5*e*) in the shape of an inverted cone opened at the top of the sleeve and communicated by its apex with the cylindrical recess 5*d* in the lower half; two separate axial holes (5*f*), also opened at the top of the sleeve and located at points diagonally opposite each other close to two of the vertex of the rectangle the shape of which is adopted by the upper half of the sleeve; and, finally, in the middle part of the upper half of the sleeve; at points diagonally opposite each other coinciding with the angle edges of the above-mentioned rectangle, two grooves (5*g*) which are normal to the axial holes 5*f* and cut through them but which do not reach axial recess 5*e*.

No. 6 are two threaded pins that pass through tubular element 1, at points diametrically opposite each other and located immediately below the interior peripheral seat 1*a*, so that their respective tips, which are smaller in diameter than their threaded portions, reach the peripheral groove (5*a*) on sleeve (5) and lodge therein, in such a way that they do not hinder the rotary movement of the sleeve but they do prevent its vertical displacement.

No. 7 are two metal pieces which are mounted on the upper part of the sleeve 5 in such a way that they are able to swing. Each of these pieces has the general shape of an angle with an aperture slightly larger than that of two adjacent sides of the rectangle formed by the upper half of the above-mentioned sleeve, so that the swinging motion of the said pieces is checked by the contact of their respective larger or smaller sides with the larger or smaller sides of the aforementioned rectangle.

Each of the said pieces has a tongue on its upper and its lower edge, said tongues being unequal but parallel to each other. The upper tongue (7*a*), greater than the lower one, is in the shape of a hook; it has less weight than the larger side of the piece 7 itself, and it is designed to pass over the top of sleeve 5, so as to enter or not the area of the central opening or recess 5*e* of the sleeve depending on the swinging direction of the piece 7. The lower tongue (7*b*) is intended to fit into the corresponding groove 5*g* on said sleeve.

No. 8 are respective holes with which tongues 7*a* and 7*b* of each of the pieces 7 are provided. The hole in the upper tongue coincides with the one in the lower tongue.

No. 9 are the pins which, after piercing the tongues 7*a* and 7*b* of each piece 7 through their respective holes 8, are inserted into the axial orifices 5*f* in the sleeve (5), said pins serving as fastening elements and, at the same time, as axes for the swinging movement of said pieces 7 with respect to the sleeve 5.

No. 10 is a generally cylindrical shaft which is housed within the tubular element 1 in such a way that its top or head fits rightly into the cylindrical recess 5*d* in the lower half of the sleeve 5 and its bottom end or tail passes through the hole in the centre of internal partition (1*b*) and protrudes below it.

No. 11 is the transverse hole provided in the bottom end or tail of shaft 10.

No. 12 is a rubber band or any other suitable elastic element which is attached to the hole 11 in the bottom end or tail of shaft (10) and to the hook 3 on the cap 2.

No. 13 is another transverse hole with which the shaft 10 is provided near its middle and which enables some string or other suitable element to be wound around said shaft, said string or element being arranged so as to be grasped through an opening (not shown) made for that purpose in the tubular element 1.

No. 14 is said piece of string.

No. 15 is a cam that is integral on shaft 10 immediately above the hole 13 and that has two teeth or projections (15*a*) on its top, forming two inclined planes.

No. 16 is a second cam mounted on shaft 10, with the possibility both to rotate and to vertically move, although this vertical movement is limited to the distance existing between the first cam 15 and the lower base of the sleeve 5. This cam is provided at the bottom with teeth or projections (16*a*) and inclined planes analogous to those on the first cam 15, so that, when it falls down by gravity on this latter cam 15, both cams fit together so as to form a cylindrical body.

In addition, this second cam has two axial holes (16*b* and 16*c*, respectively), arranged in such a manner that they are opposite orifices 5*b* and 5*c* in the lower half of the sleeve 5, there being a rod inserted in each respective pair of opposed orifices.

No. 17 are said rods.

No. 18 is the rotating flying element, which in the embodiment shown and described by way of example comprises a wheel-like body equipped with helical wings but which may be given any suitable shape or form for the purpose for which it is intended. From the centre of said element a long cylindrical shaft (18*a*) projects downwards and ends in an inverted cone (18*b*), the base of which is slightly greater in diameter than the diameter of the above-mentioned shaft 18*a*. The dimensions of said inverted cone 18*b* correspond to those of the opening or recess 5*e* in the sleeve 5 in which it is designed to lodge.

Furthermore, from the centre of said rotating flying element 18 a short neck (18*c*) projects up-wards, said neck having a cylindrical cap (18*d*) mounted thereon for free rotation. Also, the cap may optionally be topped with a small piece of resilient material suitable for absorbing the shock produced when the rotating flying element hits against, for example, the ceiling of a room.

No. 19 is a small rod that passes transversely through the cylindrical shaft 18*a* of the rotating flying element 18 at the point where the shaft joins the base of the inverted cone 18*b* at its lower end. The length of this rod is equal to the diameter of the base of the cone, so that the respective ends of the rod extend beyond the sides of the shaft at two points opposite each other.

The toy operates in the following manner:

First, the rotating flying element 18 is disposed as shown in FIG. 1, that is, with the inverted cone 18*b* at the lower end of its cylindrical shaft 18*a* lodged in the opening or recess 5*e* of the same shape made in the sleeve 5. The opening 5*e* is easily accessible through flared piece 4.

When the string 14 wound around the shaft 10 is subsequently pulled, this shaft rotates together with the cam 15 which is integral with it. Since cam 16 tends, because of its own weight, to rest on cam 15 and engaged with it, the rotary movement of the latter is transmitted to the former and, through rods 17, to the sleeve 5 and to the metal pieces 7 mounted on the said sleeve. Since the longer sides of these pieces 7 weigh more than their respective hook-shaped tongues 7*a*, they tend, due to centrifugal force, to move away from the sleeve 5, whereas said tongues, on the contrary, are displaced inwards. As a result, they hook on to the protruding ends of rod 19 and, via these ends, cause to rotate the cylindrical shaft 18*a* of the rotating flying element 18 and hence the flying element itself.

When the string 14, which is securely fastened to the hole 13 in the shaft 10, has been completely unwound, the rotary motion of said shaft is suddenly stopped, and the sleeve 5 presses against the inner wall of tubular element 1, so that it is also stopped instantaneously. Then, due to inertia, the longer and heavier sides of the pieces 7 tend to approach the sleeve 5, while the hook-shaped tongues 7*a* are displaced outwards, thus leaving free the protruding ends of the rod 19 and allowing the cylindrical shaft 18*a*, and with it the entire rotating flying element, to rise up vertically on account of its rotating motion.

As the speed of rotation of the rotating flying element 18 decreases as a result of friction with the air, the flying element descends with its shaft 18*a* keeping a vertical position. Since the piece 4 at the top of the tubular element 1 is a flared, opening outwards piece, the user can catch the rotating flying element directly with the launching mechanism, for which all he has to do is, as the flying element 18 descends, let its shaft 18*a* slide down the inclined sides of flared piece 4, until the end of the shaft, with the shape of an inverted cone 18*b*, lodges in the similarly shaped opening or recess 5*e* in sleeve 5. The flying element will thus be in position and ready to be launched again, and this procedure can be repeated as many times as desired, the skill and wishes of the user being the only limitation.

Alternatively, the rotating flying element can be allowed to land on any surface and to spin on that surface as if it were a top; it can then be picked up by its cap 18*d* and carried freely about, without interfering with its spinning motion.

As has already been explained, to the bottom end or tail of the shaft 10 is attached one end of a rubber band 12 or any other suitable elastic element, and other end of which is secured to the hook 3 on the bottom cap 2. As a result, when the string 14 is pulled and the shaft 10 rotates, this rubber band is twisted, and when the string is released, the rubber band returns to its normal or original position, causing shaft 10 to rotate in the opposite direction. This opposite rotary motion causes the cam 16 to slip over cam 15 and to be pushed upwards by the latter cam, so that this rotary motion is not transmitted to the sleeve 5.

What I claim is:

1. A flying toy, characterized in that it comprises a tubular body provided with a flared piece at the top, said tubular body carrying in the interior one shaft, around which appropriate means is wound for causing it to rotate from outside said tubular element, and a sleeve to the base of which is connected the upper end of said shaft in such a way that the rotary motion of the shaft can be transmitted to the sleeve, said sleeve having mounted two swinging pieces specially counterweighted and positioned in such a way that, when the sleeve rotates, said swinging pieces rock because of centrifugal force and, by means of the hooks with which they are provided, they transmit the same rotary motion to a flying element that is coupled to the top of the sleeve, the action of said hooks on the flying element being stopped and said flying element being shot off or launched when the rotary motion of the shaft and the sleeve is interrupted, after the traction means wound around the shaft has been completely unwound.

2. A flying toy, according to claim 1, further characterized in that said shaft, to the lower end or tail of which is attached one end of an elastic means of torsion whose other end is connected to a hook provided at the base of the said tubular element, has two cams, a fixed one provided on its top with two teeth or projections forming respective inclined planes, and another one capable of rotating and of limited vertical displacement, which is provided on its bottom with the same teeth or projections and inclined planes as the first cam and which is attached to the sleeve by means of rods, the movable cam tending to fall by gravity onto the fixed cam and to stay engaged thereto, the respective teeth of the cams acting in such a way that, when the shaft rotates in a given direction, said rotation is transmitted by the fixed cam to the movable cam and by the latter to the sleeve, whereas, when the shaft turns in the opposite direction, the movable cam slips over the fixed one and, as a result, this rotary motion is not transmitted to the sleeve.

3. A flying toy, according to claim 1, further characterized in that the flying element has a central shaft which projects above and below said element in respective portions of different length, the upper and shorter portion having thereon a cap which is capable of rotating freely, whereas the lower and longer portion ends in a body in the shape of an inverted cone that lodges in the recess formed in the sleeve for that purpose, the shaft also having a rod that passes through it at the point where it joins the base of said conical body and the hooks of the swinging pieces mounted on the sleeve acting on the protruding ends of said rod so as to cause the rotation of the shaft and the flying element to which it is connected.

4. A flying toy, according to claim 1, further characterized in that a portion of the swinging pieces, which are shaped appropriately so as to conform to the shape of the sleeve on which they are mounted, is heavier than the hook with which they are provided, thereby achieving the gravity effect needed to ensure that said hooks keep the shaft of the flying element gripped, while the sleeve rotates, and thus force said element to attain the momentum required for it to be launched when said hooks, giving in to inertia when the sleeve ceases to rotate, move away from the shaft, the shaft keeping its vertical position during the smooth and gradual descent of the rotating flying element so that the user can catch the element directly using the launching mechanism and be in a position to launch it again, in a sequence which can be repeated an unlimited number of times.

* * * * *